United States Patent [19]

Smahlik

[11] 4,152,807

[45] May 8, 1979

[54] SCRUBBING ATTACHMENT FOR A SQUEEGEE

[75] Inventor: Michael A. Smahlik, Oakland, Calif.

[73] Assignee: Steccone Products Co., Inc., Oakland, Calif.

[21] Appl. No.: 837,832

[22] Filed: Sep. 29, 1977

[51] Int. Cl.[2] ..... A47L 1/08

[52] U.S. Cl. ..... 15/246; 15/121; 15/210 R

[58] Field of Search ..... 15/117, 121, 231, 232, 15/233, 246, 250.03, 250.36; 51/393; 401/18, 25–27

[56] References Cited

U.S. PATENT DOCUMENTS

| | | | |
|---|---|---|---|
| 614,644 | 11/1898 | Barr | 15/231 V X |
| 1,881,182 | 10/1932 | Greenstreet | 15/250.03 |
| 3,075,222 | 1/1963 | Miller | 15/209 R |
| 3,705,436 | 12/1972 | Holliday | 15/118 |
| 3,803,664 | 4/1974 | Triplett | 15/250.03 |

FOREIGN PATENT DOCUMENTS

| | | | |
|---|---|---|---|
| 713635 | 9/1966 | Italy | 15/118 |
| 6809022 | 11/1968 | Fed. Rep. of Germany | 15/121 |

*Primary Examiner*—Daniel Blum
*Attorney, Agent, or Firm*—Bruce & McCoy

[57] ABSTRACT

A scrubbing attachment which includes a sleeve for a squeegee, engagement means to secure the squeegee to the inside of the sleeve, and absorbent material surrounding the sleeve particularly adapted for cleaning.

4 Claims, 4 Drawing Figures

SCRUBBING ATTACHMENT FOR A SQUEEGEE

BACKGROUND OF THE INVENTION

1. Field of the Invention

The present invention relates to the field of cleaning equipment and more particularly to a scrubbing attachment for a squeegee.

2. Description of the Prior Art

It is common among professional as well as lay window and floor cleaners, to use squeegees to increase their efficiency and the uniformity of their results. A squeegee is an implement for removing moisture from a surface which generally includes a handle which is clamped to a channel which supports and tightly engages a wiping blade. The window or other surface to be cleaned is generally moistened with a cleaning solution and scrubbed by means of a brush or cloth. It is then wiped dry by applying the blade edge of the squeegee to the wet surface and drawing the blade under pressure along that surface. The liquid is trapped on the wet side of the wiping blade and is drawn off the window, leaving a dry surface in its trail.

The professional squeegee, which is more completely described in U.S. Pat. No. 2,123,638, issued July 12, 1938 to Ettore Steccone, has many features long appreciated by professional window cleaners. For example, the end portion of the handle of such a squeegee may be formed to partially surround the channel holding the wiping blade and it may be clamped to the channel by nuts and bolts. These nuts and bolts may be adjusted to change the tension with which the handle is secured to the channel to allow the handle to be slid along the channel and disposed at any position therealong. This allows the window washer to slide the handle to one end of the channel, for instance, to extend his or her reach to a higher or lower or otherwise inaccessible area. Extension poles may be mounted on squeegee handles to further increase the distance that the window washer may reach. The quality of the wiper blade and the configuration of the support channels may also vary with the quality and the purpose of the squeegee.

Although squeegees have been refined to a high degree, expensive and outmoded methods are still being used to perform the wetting and scrubbing stage of the cleaning process. One such approach is to use a brush or other cleaning implement to apply cleaning solution to the window or a certain portion of it. A typical cleaning implement of this type may be merely a rod covered with scrubbing material and mounted perpendicularly onto a handle. The point of attachment is usually permanent, however, thereby preventing the washer from sliding the handle laterally to increase the window cleaner's reach. One usually scrubs a surface with his or her strongest hand so that it is necessary to change implements and place the squeegee in that hand when it is time to strip off the moisture. Most separate cleaning implements are cumbersome and the need to exchange the two implements between hands interrupts the smooth operation of the window washer thereby reducing the efficiency of the operation and increasing the risk to that person when washing windows at dangerous heights.

Another obvious method for the cleaning step is to cover the squeegee with a scrubbing material and anchor it to the squeegee in some way. Then the squeegee can be used to wet and scrub the window, and when the cleaning material is removed, the squeegee blade can be used for the wiping stage. The problem of this method is that if the material is tightly secured to the squeegee it is difficult to remove it smoothly when the need to use the squeegee blade arises. Removal of certain coverings from the squeegee may cause irregularities and wearing of the edge of the wiping blade resulting in an imperfectly wiped surface. If the material is loosely attached to the squeegee, it is less effective for scrubbing and it may be dislocated when working pressure is applied in scrubbing the window. Dislocation of the scrubbing material if the window cleaner is working at a great height may create a hazard to himself or others below. Thus, even where the squeegee itself is used as the supporting structure for the cleaning material of the prior art, the transition between the cleaning stage and the wiping stage is awkward and inefficient.

Another attempt to increase the efficiency and safety of the window washing process was to permanently mount a sponge or scrubbing element onto some portion of the squeegee channel. This modified squeegee is frequently used in washing the outside of automobile windshields, for example. Generally, a material such as sponge rubber is placed along the length of the support channel on the reverse side from the wiping blade. This allows one to wet and scrub the surface and then to turn the device over and wipe it with the blade. Such a device is unsuitable for use in professionally washing vertical windows for several reasons. On the one hand, the wiper blade in such a case is most often located in a plane perpendicular to that of the handle rather than in the same plane, thereby increasing the force necessary to pull the squeegee wiper blade along the surface and resulting in the loss of wiping effectiveness. Secondly, the sponge rubber portion in such a device may be saturated with the cleaning liquid and when the implement is reversed to use the wiping blade there may be dripping from the sponge rubber portion onto the already dried surface thereby defeating the purpose of wiping the window surface dry. If the sponge is not saturated or if a brush is used then frequent communication of the sponge or brush with a source of detergent or water requires additional extra motions.

Thus there is a need for an attachment which may be easily attached and detached from a squeegee but which is tightly secured to it during use and which allows a controlled application of cleaning solution to a window without dripping and without constant contact with a liquid source and also allows the window cleaner to utilize the lateral slideability of the squeegee handle on the channel when the attachment is in place. There is also a need for a scrubbing attachment which allows a window washer to hold the squeegee without exchanging it for another implement during the washing process. The present invention provides a solution to these problems of the prior art.

SUMMARY OF THE INVENTION

The present invention is an improved scrubbing attachment for a squeegee. It includes an elongated cylindrical sleeve which has a slot disposed in the side wall through which a squeegee can be inserted. Securement means for the squeegee are formed within the sleeve to engage it and stabilize it with respect to the squeegee. The cylindrical sleeve is surrounded by an absorbent material which has a uniform thickness and an external texture particularly adapted for cleaning flat surfaces.

OBJECTS OF THE INVENTION

It is therefore an important object of the present invention to provide an effective cleaning and wetting means for windows or other comparatively flat surfaces.

It is a further object of the present invention to provide an implement which allows the user to control the application of water or cleaning solution to a surface.

It is another object of this invention to provide a scrubbing attachment which reduces undesired dripping and can be used to absorb excess moisture from the surface being cleaned.

It is still a further object of the invention to provide a lightweight cleaning and wetting implement which can be easily carried and attached to or detached from a squeegee during the course of the cleaning process without removing the squeegee from the working hand.

It is still another object of the invention to provide a device which can be easily and inexpensively formed from an extruded material having an absorbent surface secured thereto.

It is yet a further object of the invention to provide an improved scrubbing attachment which will uniquely fit a squeegee so that the attachment can be secured to the squeegee and there will be no wobbling or undirected rotation of the attachment relative to the squeegee.

It is yet another object of the present invention to provide a scrubbing attachment which while in place permits the squeegee handle to be easily moved along the length of the squeegee channel to enable a window cleaner to extend his reach and to scrub otherwise inaccessible surfaces.

Other objects and advantages of the invention will become apparent when it is considered in conjunction with the accompanying drawings described hereafter.

DESCRIPTION OF THE PREFERRED EMBODIMENT

Figure 1:
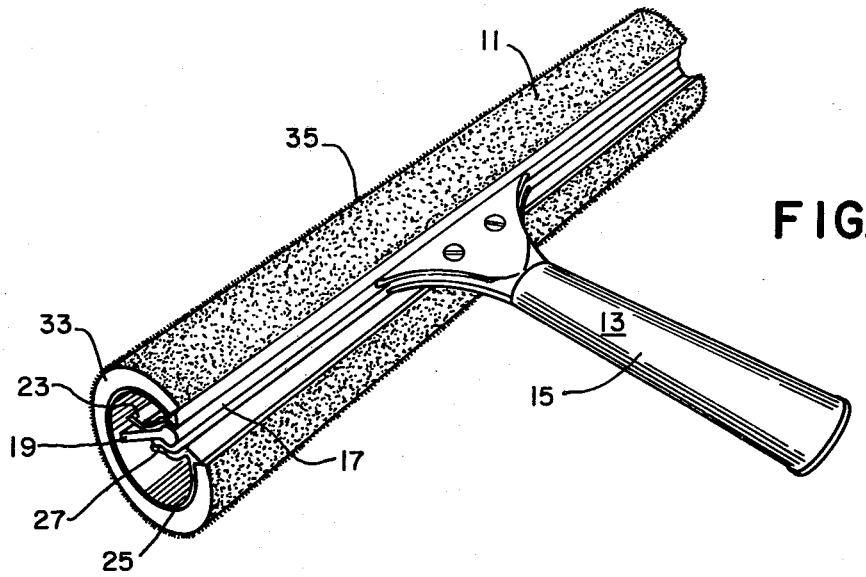
FIG. 1 is a perspective view of the improved scrubbing attachment shown mounted on a squeegee.
Figure 2:
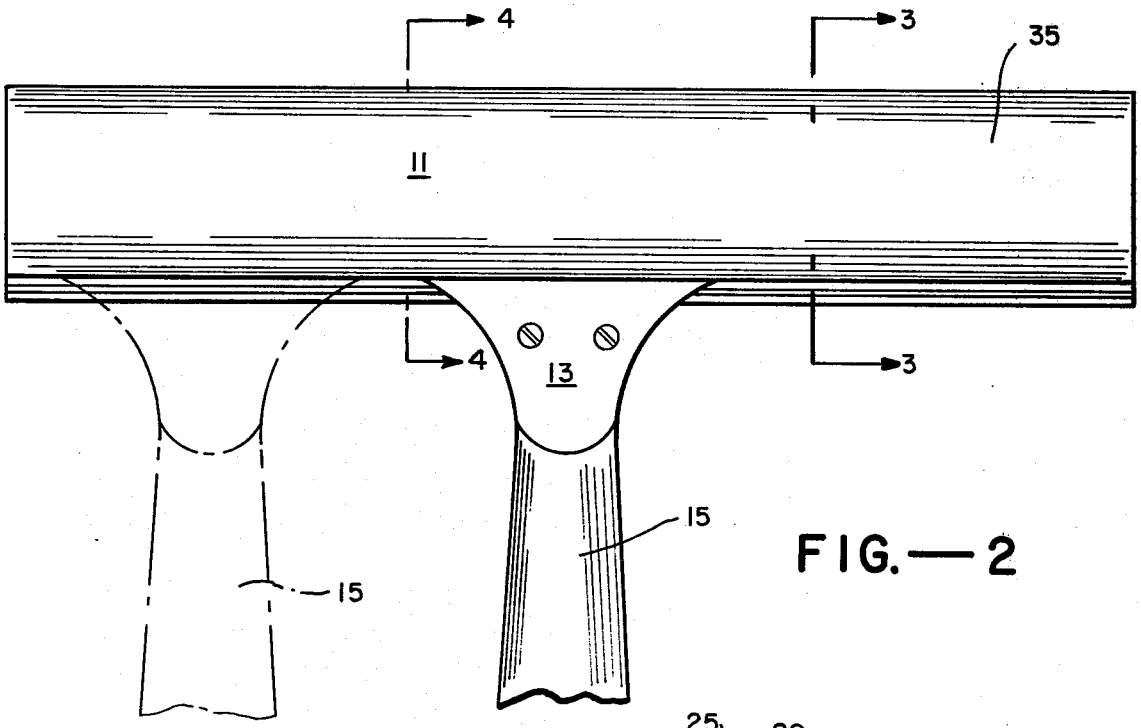
FIG. 2 is a side elevational view of the present invention shown attached to a squeegee.

The present invention is an improved scrubbing attachment 11 for a squeegee 13. The squeegee referred to herein generally includes a handle 15, attached to a support channel 17 which holds the wiping blade 19 of the squeegee. The present invention is particularly adapted to a squeegee having a support channel which is formed from an elongated tubular portion 21 and a pair of lip extensions 23 projecting from the tubular portion along its length to support the flexible wiping blade which is usually formed out of rubber to the like. In a high quality squeegee, the handle will be slidable along the entire length of the support channel as illustrated in FIG. 2, allowing it to be held in position anywhere along the channel.

Figure 3:
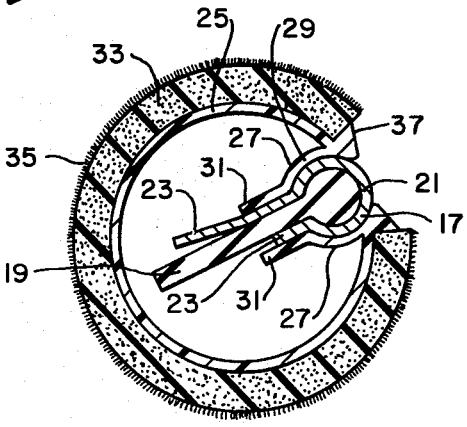
FIG. 3 is a cross-sectional view of the present invention with the squeegee support channel enclosed within taken along the line 3—3 of FIG. 2.
Figure 4:
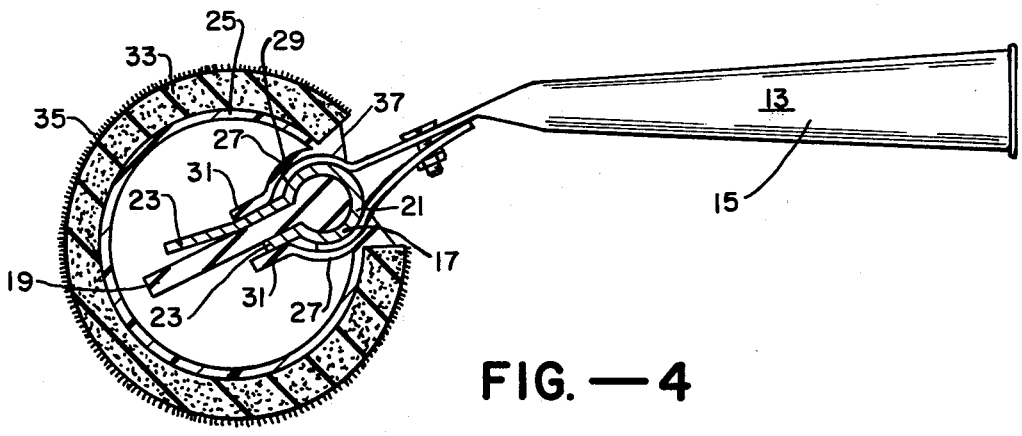
FIG. 4 is a cross-sectional view of the present invention with the squeegee support channel and a portion of the squeegee handle enclosed therein taken along line 4—4 of FIG. 2.

The improved scrubbing attachment 11 of the present invention includes an elongated cylindrical sleeve 25 having a longitudinal slot disposed in the side wall thereof whereby the blade and channel portion of a squeegee 13 can be inserted into and substantially enclosed within the slot. This sleeve may be formed of a material which urges the edges of the slot together to securely grasp the squeegee yet permits the squeegee to be inserted therebetween. In the preferred embodiment the cylindrical sleeve is formed of a material sufficiently pliable to accommodate a squeegee handle 15 and channel 17 disposed in the longitudinal slot and to permit the handle to be attached to the squeegee support channel anywhere along the length of the longitudinal slot. This material may preferably be a nonbrittle plastic or lightweight metal. The elongated cylindrical sleeve may be formed from a continuous extrusion so that lengths of the extrusion can be selected to fit varying lengths of squeegee channels. As seen in FIG. 3, the extrusion has a diameter large enough to enclose the squeegee without contacting the wiping blade, thereby avoiding wear or damage to the edge of the blade 19 when in place or during attachment or detachment of the sleeve from the squeegee.

Means formed within the sleeve for engaging the squeegee securely support the engagement of the scrubbing attachment 11 with respect to the squeegee 13. This engagement means may include forming the sleeve of a material which urges the edges of the longitudinal slot together. Flanges 27 which are inwardly projecting from the elongated cylindrical sleeve 25 may also be formed on the edges of the slot for grasping the squeegee therebetween. These inwardly projecting flanges have a configuration in cross-section which surrounds a portion of the cross-section of the squeegee support channel 17 to firmly stabilize the sleeve in relation to the squeegee when it is secured thereto. In the preferred embodiment, these inwardly projecting flanges have opposed configurations along an axis coincident with the diameter of the cylindrical sleeve and each of the inwardly projecting flanges has a curved portion 29 to correspond with and to engage the tubular portion 21 of the squeegee support channel. This curved portion is generally concave and in the preferred embodiment commences proximate its junction with the sleeve. An inner end portion 31 of the inwardly projecting flange may be angled away slightly from the diameter of the sleeve and is particularly suited for engaging the lip extensions 23 of the support channel to prevent rotation of the support channel inside the cylindrical sleeve. The inwardly projecting flanges in the preferred embodiment are integrally attached to the cylindrical sleeve and may also be part of the continuous extrusion.

An absorbent material 33 having a generally uniform thickness is secured to the external surface of the cylindrical sleeve 25. This absorbent material has an external surface 35 particularly adapted for cleaning flat surfaces. In the preferred embodiment the absorbent material consists of a sponge material or the like with an external surface formed from an electrostatically applied nap which is permeable to a cleaning solution. This sponge material has a comparatively thick inner portion which may be glued to the external surface of the cylindrical sleeve and which is absorbent to cleaning solutions whereby such solutions can be absorbed or released from the sponge material through its permeable external surface without excessive dripping on the surface to be cleaned or on other surfaces. Of course, it is to be understood that various other absorbent materials with similar water retention and release characteristics could be effectively utilized in practicing this invention and are considered to be within the scope of the invention.

In the preferred embodiment the elongated cylindrical sleeve 25 also has a pair of outwardly projecting flanges 37 disposed on the outer edges of the longitudinal slot and angled obliquely away from each other. These generally short flanges are positioned to protect the ends of the absorbent material 33 at their point of adhesion to the sleeve. These outwardly projecting flanges are also integrally attached to the cylindrical sleeve and may be continuously extruded with the cylindrical sleeve and the inwardly projecting flanges.

In the preferred embodiment, the elongated cylindrical sleeve 25 is formed so that the edges of the longitudinal slot are urged closely together and the sleeve is substantially closed when removed from the squeegee 13. The insertion of the squeegee into the elongated cylindrical sleeve forces the edges of the slot apart and causes the end portions 31 of the inwardly projecting flanges 27 to move more tightly against the lip extensions 23 of the support channel 17. Thus, the sleeve is maintained in a stable position relative to the squeegee channel and it will act as a part of that element when in place.

The material and configuration of the sleeve still permit the squeegee handle to be moved along the support channel while the squeegee attachment is in place, thus retaining the special features of the high quality squeegee. The configuration of this attachment is uniquely adapted to encompass a squeegee and to protect the fine edge of the blade from contact and wear, thus prolonging the functional life of the wiping blade.

The layer of absorbent material which is secured to the outside of the cylindrical sleeve allows either the release or the retention of liquids without dripping. In the preferred embodiment the electrostatic nap surrounding the absorbent portion of the scrubbing material facilitates the release of dirt or other particles adhering to the surface to be cleaned. Because of the permeability of the electrostatic nap, cleaning solution may be released from the absorbent material to the surface to be cleaned or used cleaning solution may be absorbed from such surface. Thus, the present invention is an improved lightweight scrubbing attachment which can be easily carried by a window washer and mounted on the support channel of a squeegee to allow the window washer to alternately wet and scrub the window and remove the attachment to wipe it dry with the squeegee in a smooth and fast operation without removing the squeegee from the washer's hand. This invention thus increases the efficiency of and reduces the risk to window washers at high locations.

It will be seen that the above-described scrubbing attachment will achieve all the advantages and objects attributed to it, and while it has been described in detail, it is not to be limited to such details except as may be necessitated by the appended claims.

I claim:

1. An improved scrubbing attachment for a squeegee having a handle secured to a support channel which holds the wiping blade of the squeegee, the improvement comprising an elongated substantially rigid cylindrical sleeve having a longitudinal slot disposed through a side wall for the length thereof, said sleeve formed of a material which urges the edges of the slot together to grasp at least a portion of the support channel of the squeegee yet is flexible enough to permit the squeegee to be inserted therebetween, said sleeve defining an inner chamber which substantially surrounds the support channel and wiping blade of the squeegee and protects the wiping edge of said blade against contact with said attachment, a pair of inwardly projecting flanges formed on the edges of said slot of said sleeve and extending substantially along the length of said slot for clamping onto the channel portion of the squeegee, said flanges having a partially curved configuration which conforms to a portion of the external configuration of the support channel of the squeegee to partially surround and clamp onto it to stabilize the sleeve in relation to said squeegee when secured thereto, and a relatively thick material having sponge-like qualities absorbent to cleaning solutions secured to the external surface of said sleeve and having a uniform thickness and a permeable external texture particularly adapted for scrubbing flat surfaces.

2. An improved scrubbing attachment for a squeegee having a handle secured to a support channel which holds the wiping blade of the squeegee, the attachment comprising an elongated substantially rigid cylindrical sleeve having at least one open end and a longitudinal slot disposed in a side wall along substantially the length thereof, the inner surface of said sleeve defining a chamber to substantially surround the support channel and wiping blade of a squeegee inserted in said longitudinal slot, said chamber being formed to protect the free edge of the wiping blade against contact with any part of said attachment, said sleeve formed of a material which urges the edges of the slot together to grasp the squeegee support channel, said material being pliable enough to accommodate a portion of the squeegee handle at any position along the length of the slot, a pair of inwardly projecting flanges disposed in said sleeve formed on the edges of said slot along a substantial portion of the length of the slot, said flanges being disposed in opposed relation and having a concave portion and a straight inner end portion for engaging the squeegee support channel to stabilize the attachment against rotation around the squeegee support channel, said elongated cylindrical sleeve and inwardly projecting flanges having a continuous cross-section, and a cover secured to the sleeve having an inner layer of sponge material absorbent to cleaning solutions or the like and an external scrubbing surface permeable to liquids, said surface being formed from an electrostatically applied nap whereby liquid solutions can be held or released by the inner layer through the permeable scrubbing surface to permit the application of said solutions to a flat surface and the scrubbing thereof and the absorption of moisture from said surface without excessive dripping.

3. The improved scrubbing attachment of claim 2 wherein the elongated cylindrical sleeve has a pair of outwardly projecting flanges disposed on the outer edges of the longitudinal slot and angled obliquely away from each other to protect the attachment ends of the absorbent material to the sleeve.

4. An improved scrubbing attachment for a squeegee having a handle secured to a support channel which holds the wiping blade of the squeegee, the improvement comprising an elongated substantially rigid cylindrical sleeve defining an inner cavity which has a uniform cross-section along its length and a longitudinal slot extending through the side wall for the length thereof, said sleeve being formed of a material which urges the edges of the slot together to grasp the support channel of the squeegee when it is inserted into said slot such that the wiping edge of the squeegee blade will be protected by said inner cavity from contacting the attachment during scrubbing, said material being sufficiently pliable to permit the end portion of the squeegee handle which is attached to the support channel to be slidably disposed at any position along the length of the support channel, a pair of inwardly projecting flanges formed on the edges of said slot along at least a portion of the length of the sleeve, said flanges having a partially curved configuration which conforms to a portion of the external configuration of the support channel of the squeegee to partially surround it and to stabilize the squeegee support channel from rotation inside the cylindrical sleeve, and a layer of relatively thick material having sponge-like quality of uniform thickness and absorbent to cleaning solutions permanently secured to the external surface of the cylindrical sleeve, said absorbent material having a permeable external texture particularly adapted for scrubbing flat surfaces whereby cleaning solutions can be absorbed or released from the absorbent material through the permeable external surface without excessive dripping.

* * * * *